US008654155B2

(12) United States Patent
Yu et al.

(10) Patent No.: US 8,654,155 B2
(45) Date of Patent: Feb. 18, 2014

(54) DISPLAY DEVICE AND METHOD FOR DRIVING THE SAME

(75) Inventors: Sang-Ho Yu, Gumi-si (KR); Kyoung-Don Woo, Gumi-si (KR); Young-Jun Hong, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 994 days.

(21) Appl. No.: 12/458,555

(22) Filed: Jul. 15, 2009

(65) Prior Publication Data

US 2010/0020111 A1 Jan. 28, 2010

(30) Foreign Application Priority Data

Jul. 25, 2008 (KR) ..... 10-2008-0072942

(51) Int. Cl.
*G09G 5/10* (2006.01)

(52) U.S. Cl.
USPC ..... 345/690; 345/204; 345/87; 714/758; 714/819; 714/699; 714/746

(58) Field of Classification Search
USPC ..... 345/87, 204, 690; 714/758, 819, 746
See application file for complete search history.

(56) References Cited

U.S. PATENT DOCUMENTS

| | | | | | |
|---|---|---|---|---|---|
| 5,455,905 | A * | 10/1995 | Kaya et al. | ..... | 345/501 |
| 5,576,738 | A * | 11/1996 | Anwyl et al. | ..... | 345/212 |
| 6,101,620 | A * | 8/2000 | Ranganathan | ..... | 714/718 |
| 6,839,055 | B1 * | 1/2005 | Nguyen | ..... | 345/204 |
| 7,375,723 | B2 * | 5/2008 | Cheon et al. | ..... | 345/204 |
| 7,414,619 | B2 * | 8/2008 | Kim | ..... | 345/204 |
| 7,916,106 | B2 * | 3/2011 | Kim | ..... | 345/89 |
| 7,969,432 | B2 * | 6/2011 | Hall | ..... | 345/418 |
| 2009/0191995 | A1 * | 7/2009 | Hamada et al. | ..... | 474/94 |

FOREIGN PATENT DOCUMENTS

| | | |
|---|---|---|
| JP | 2007-047426 | 2/2007 |
| KR | 10-2005-0079243 | 8/2005 |
| KR | 10-2005-0090644 | 9/2005 |
| KR | 10-2007-0102882 | 10/2007 |

* cited by examiner

*Primary Examiner* — Grant Sitta
(74) *Attorney, Agent, or Firm* — McKenna Long & Aldridge, LLP

(57) ABSTRACT

Disclosed is a display device including a first storage unit having driving data for driving a display panel and a first check SUM data on the driving data stored therein, a second storage unit for retrieving the driving data and the first check SUM data from the first storage unit and storing the driving data and the check SUM data in response to the instruction of a ROM interface, and a data error detection/correction unit generating a second check SUM data with reference to the driving data stored in the second storage unit.

6 Claims, 4 Drawing Sheets

| Description | Index | 1B7 | 1B6 | 1B5 | 1B4 | 1B3 | 1B2 | 1B1 | 1B0 |
|---|---|---|---|---|---|---|---|---|---|
| Drive data | 00h | 0 | 1 | 0 | 1 | 1 | 1 | 0 | 1 |
| | ⋮ | | | | | | | | |
| | xxh | 1 | 1 | 1 | 0 | 1 | 0 | 1 | 0 |
| Check SUM data | (xx+1)h | ~{SUM[00h : xxh]} + 1'b1 | | | | | | | |

FIG. 3

| Description | Index | 1B7 | 1B6 | 1B5 | 1B4 | 1B3 | 1B2 | 1B1 | 1B0 |
|---|---|---|---|---|---|---|---|---|---|
| Drive data | 00h | 0 | 1 | 0 | 1 | 1 | 1 | 0 | 1 |
| | | | | | ⋮ | | | | |
| | xxh | 1 | 1 | 1 | 0 | 1 | 0 | 1 | 0 |
| Check SUM data | (xx+1)h | ~{SUM[00h : xxh]} + 1'b1 | | | | | | | |

DISPLAY DEVICE AND METHOD FOR DRIVING THE SAME

CROSS REFERENCE TO RELATED APPLICATION

This application claims the benefit of Korean Patent Application No. 10-2008-72942, filed on Jul. 25, 2008, which is hereby incorporated by reference for all purposes as if fully set forth herein.

BACKGROUND OF THE DISCLOSURE

1. Field of the Disclosure

The present invention relates to display devices, and, more particularly, to a display device which enables to prevent storage of a driving data with the driving data distorted by external noise, and a method for driving the same.

2. Discussion of the Related Art

In current information oriented society, importance of the display device as a visual information transmission medium is emphasized more than any time else, and many kinds of flat panel display devices are under development.

In the flat type display devices, there are liquid crystal display device LCD, field emission display device FED, plasma display panel PDP, electroluminescence EL, and so on.

Since display panels of each of the display devices show display characteristics different from one another depending on fabrication environments even if the display panels are fabricated under identical process, the display panels require driving conditions taking the display characteristics into account. Information on the driving conditions is stored in an external memory as a driving data.

The display device retrieves the driving data from the external memory before displaying a picture, stores the driving data in a built-in memory, and drives the display panel with reference to the driving data stored in the built-in memory.

In this instance, the driving data is liable to be distorted by external noise or static electricity in a process the driving data is transmitted from the external memory to the built-in memory. Then, the driving data distorted and stored in the built-in memory impairs a picture quality of the display panel that is driven by the distorted driving data.

Thereby, it causes customer complaints and deteriorates product reliability.

SUMMARY OF THE DISCLOSURE

Accordingly, the present invention is directed to a display device, and a method for driving the same.

An object of the present invention is to provide a display device, and a method for driving the same, in which presence of an error in a driving data is determined by using a check SUM data, and, if there is the error in the driving data, the driving data is transmitted from an external memory to a built-in memory again for maintaining the driving data stored in the built-in memory the same with the driving data stored in the external memory, always.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes a first storage unit having a driving data required for driving a display panel and a first check SUM data on the driving data stored therein, a second storage unit for retrieving the driving data and the first check SUM data from the first storage unit and storing the driving data and the check SUM data therein in response to the instruction of a ROM interface, and a data error detection/correction unit for generating a second check SUM data with reference to the driving data stored in the second storage unit, comparing the second check SUM data with the first check SUM data from the second storage unit, and driving the ROM interface such that the second storage unit retrieves the driving data and the first check SUM data from the first storage unit, again if a value of the first check SUM data and a value of the second check SUM data are different from each other.

The data error detection/correction unit includes a check SUM generating unit for generating a second check SUM data with reference to the driving data from the second storage unit; and a check SUM comparing unit for comparing the second check SUM data from the check SUM generating unit with the first check SUM data from the second storage unit, and, generating a driving signal and supplies the driving signal to the ROM interface if a value of the first check SUM data and a value of the second check SUM data are different from each other; wherein the ROM interface re-supplies the driving data and the first check SUM data from the first storage unit to the second storage unit in response to the driving signal from the check SUM comparing unit.

The display device further includes a gamma reference voltage generating unit for generating a plurality of gamma reference voltages according to the driving data from the second storage unit, and a data driver for generating a plurality of gamma voltages by using the gamma reference voltages from the gamma reference voltage generating unit, and converting a picture data from a frame memory to the gamma voltage and supplies the gamma voltage to data lines in the display panel.

The picture data include red picture data for displaying the red pictures, green picture data for displaying green pictures, and blue picture data for displaying blue pictures, the plurality of gamma voltages include a plurality of red gamma voltages for the red picture data, a plurality of green gamma voltages for the green picture data, and a plurality of blue gamma voltages for the blue picture data, the gamma reference voltages include a plurality of red gamma reference voltages required for generation of the red gamma voltages, a plurality of green gamma reference voltages required for generation of the green gamma voltages, and a plurality of blue gamma reference voltages required for generation of the blue gamma voltages, and the driving data include a plurality of red driving data which are digital signals representing the red gamma reference voltages respectively, a plurality of green driving data which are digital signals representing the green gamma reference voltages respectively, and a plurality of blue driving data which are digital signals representing the blue gamma reference voltages respectively.

The first check SUM data includes a first red check SUM data generated with reference to the red driving data stored in the first storage unit, a first green check SUM data generated with reference to the green driving data stored in the first storage unit, and a first blue check SUM data generated with reference to the blue driving data stored in the first storage unit, wherein the first red check SUM data is generated by a method including the steps of generating a SUM red driving data by summing of all of the red driving data each having n bits, discarding overflow bits exceeding the n bits from the SUM red driving data to generate the SUM red driving data of n bits, and adding an 1 to a least significant bit of the n bit SUM red driving data, and inverting logic of all bits of the n bit SUM red driving data having the 1 added thereto, the first green check SUM data is generated by a method including the steps of generating a SUM green driving data by summing of all of the green driving data each having n bits, discarding overflow bits exceeding the n bits from the SUM green driving data to generate the SUM green driving data of n bits, and adding an 1 to a least significant bit of the n bit SUM green driving data, and inverting logic of all bits of the n bit SUM green driving data having the 1 added thereto, and the first blue check SUM data is generated by a method including the steps of generating a SUM blue driving data by summing of all of the blue driving data each having n bits, discarding overflow bits exceeding the n bits from the SUM blue driving data to generate the SUM blue driving data of n bits, and adding an 1 to a least significant bit of the n bit SUM blue driving data, and inverting logic of all bits of the n bit SUM blue driving data having the 1 added thereto.

The second check SUM data includes a second red check SUM data generated with reference to the red driving data stored in the second storage unit, a second green check SUM data generated with reference to the green driving data stored in the second storage unit, and a second blue check SUM data generated with reference to the blue driving data stored in the second storage unit, wherein the second red check SUM data is generated by a method including the steps of generating a SUM red driving data by summing of all of the red driving data each having n bits, discarding overflow bits exceeding the n bits from the SUM red driving data to generate the SUM red driving data of n bits, and adding ana 1 to a least significant bit of the n bit SUM red driving data, and inverting logic of all bits of the n bit SUM red driving data having the 1 added thereto, the second green check SUM data is generated by a method including the steps of generating a SUM green driving data by summing of all of the green driving data each having n bits, discarding overflow bits exceeding the n bits from the SUM green driving data to generate the SUM green driving data of n bits, and adding an 1 to a least significant bit of the n bit SUM green driving data, and inverting logic of all bits of the n bit SUM green driving data having the 1 added thereto, and the second blue check SUM data is generated by a method including the steps of generating a SUM blue driving data by summing of all of the blue driving data each having n bits, discarding overflow bits exceeding the n bits from the SUM blue driving data to generate the SUM blue driving data of n bits, and adding 1 to a least significant bit of the n bit SUM blue driving data, and inverting logic of all bits of the n bit SUM blue driving data having the 1 added thereto.

The check SUM comparing unit compares the first red check SUM data with the second red check SUM data, the first green check SUM data with the second green check SUM data, and the first blue check SUM data with the second blue check SUM data.

The first storage unit is a ROM (Read Only Memory), and the second storage unit is a RAM (Random Access Memory).

In another aspect of the present invention, a method for driving a display device includes the steps of storing a driving data required for driving a display panel and a first check SUM data on the driving data in a first storage unit, retrieving the driving data and the first check SUM data from the first storage unit and storing the driving data and the check SUM data in a second storage unit in response to the instruction of a ROM interface, generating a second check SUM data with reference to the driving data stored in the second storage unit, and comparing the second check SUM data with the first check SUM data from the second storage unit, and supplying the driving data and the first check SUM data from the first storage unit to the second storage unit again if a value of the first check SUM data and a value of the second check SUM data are different from each other.

The method further includes the steps of generating a plurality of gamma reference voltages with reference to the driving data from the second storage unit, generating a plurality of gamma voltages by using the gamma reference voltages, and converting a picture data from a frame memory into a gamma voltage and supplying the gamma voltage to data lines in the display panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 3 illustrates driving data of a color relevant to either a first check SUM data or a second check SUM data and a check SUM data derived from the driving data of a color.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
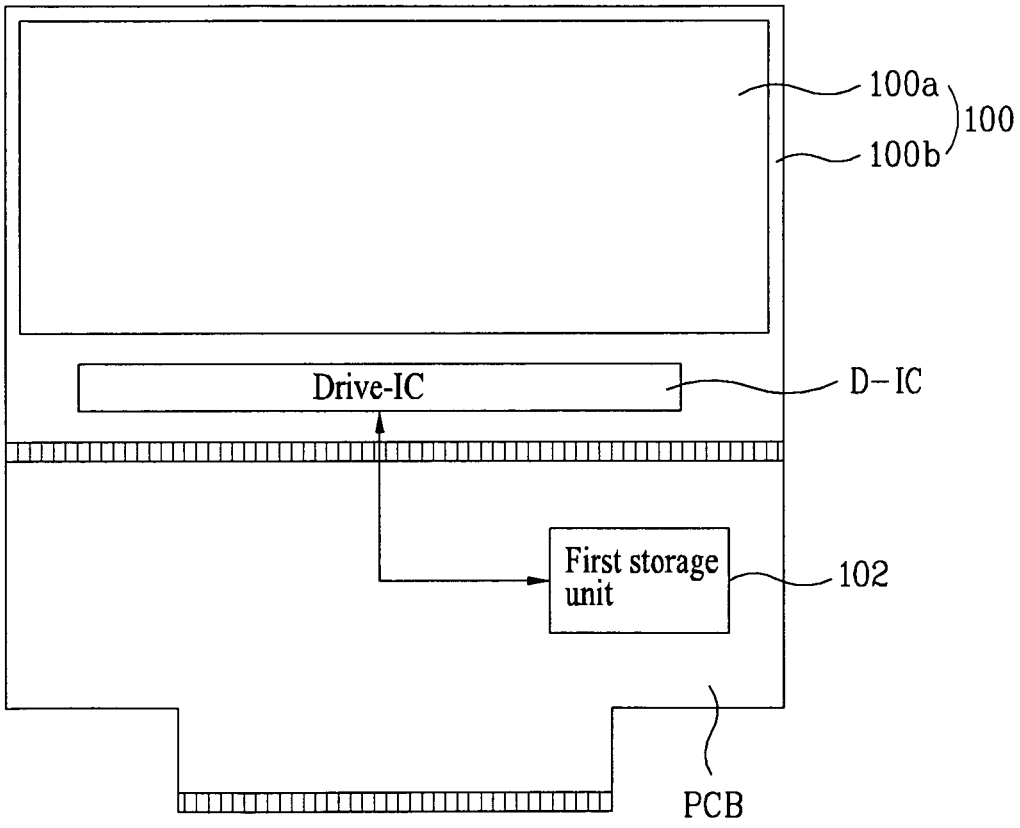
FIG. 1 illustrates a diagram of a display device in accordance with a preferred embodiment of the present invention.

FIG. 1 illustrates a diagram of a display device in accordance with a preferred embodiment of the present invention.

Referring to FIG. 1, the display device includes a display panel 100 having a display portion 100*a* for displaying a picture, a drive IC D-IC for supplying a scan pulse to gate lines in the display panel 100 in succession for driving the gate lines in succession, and supplying an analogous gamma voltage relevant to a digital picture data to data lines in the display panel 100, and a first storage unit 102 having a driving data and a first check SUM (summation) data stored therein. The drive IC D-IC is formed at a periphery of the display panel 100, i.e., at a non-display portion 100*b* of the display panel 100, and the first storage portion 102 is formed on a PCB.

The driving data stored in the first storage unit 102 is various kinds of data required for driving the display panel 100. Since display panels 100 of the same standard show characteristics different from one another depending on fabrication environments even if the display panels are fabricated under the same process, the display panels 100 require driving conditions taking characteristics of the display panels 100 into account. Information on the driving conditions is stored in the first storage unit 102, and a data including the information is the driving data. The driving data may have value varied with the display panels 100.

The display panel 100 may be a field emission display device FED, a plasma display panel PDP, or an electroluminescence EL.

Figure 2:
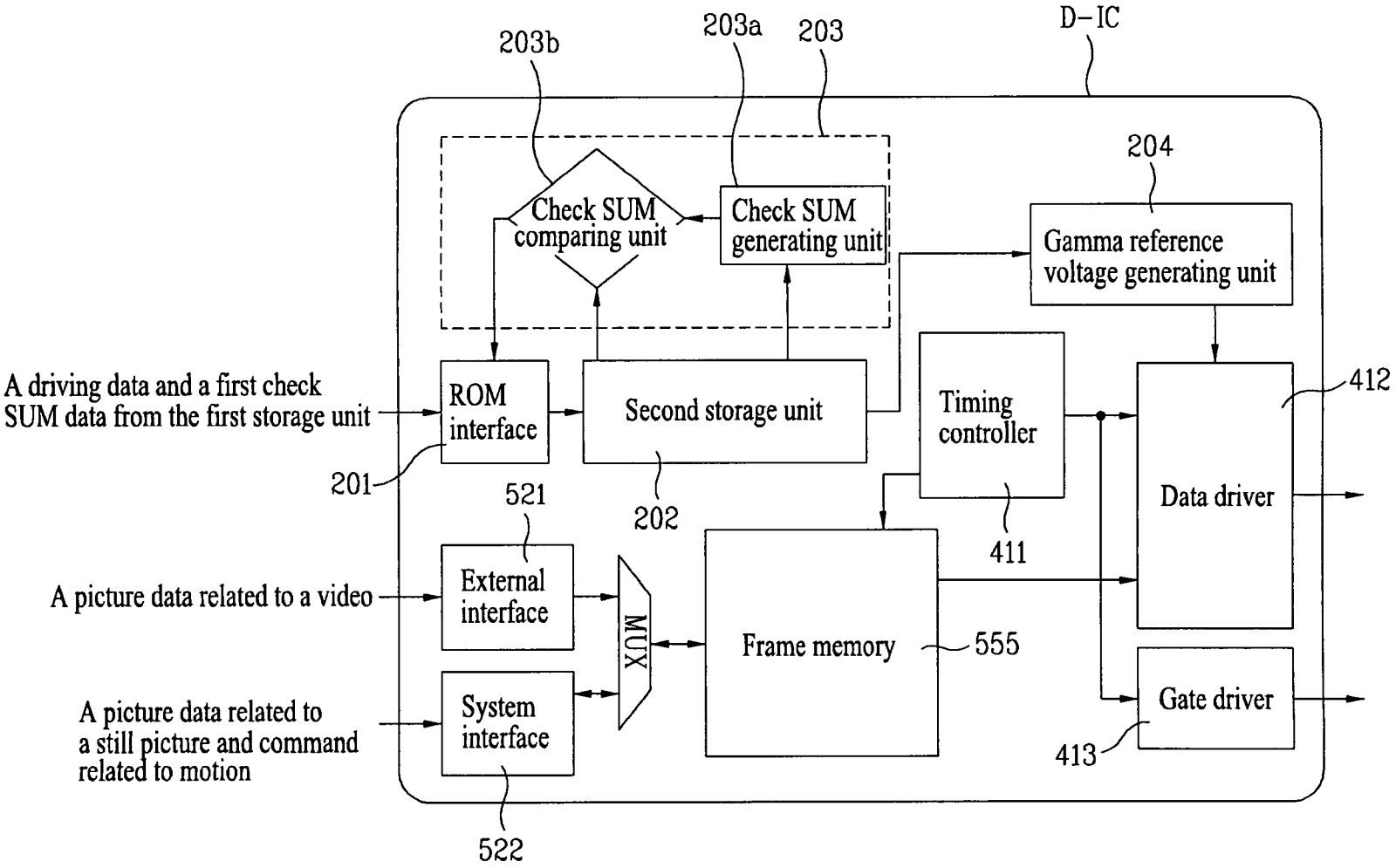
FIG. 2 illustrates a block diagram of the drive IC in FIG. 1.

FIG. 2 illustrates a block diagram of the drive IC in FIG. 1.

Referring to FIG. 2, the drive IC D-IC includes a ROM interface 201, a second storage unit 202, a data error detection/correction unit 203, a timing controller 411, a gamma reference voltage generating unit 204, an external interface 521, a system interface 522, a multiplexer MUX, a frame memory 555, a data driver 412, and a gate driver 413.

The second storage unit 202 retrieves the driving data and the check SUM data from the first storage unit 102 and stores the driving data and the check SUM data therein under the instruction from the ROM interface 201.

The first storage unit 102, a ROM (Read Only Memory), is an external memory, and the second storage unit 202, a RAM (Random Access Memory), is a built-in memory. The first storage unit 102 may be built in the drive IC D-IC.

The data error detection/correction unit 203 generates a second check SUM data with reference to the driving data stored in the second storage unit 202, compares the second check SUM data to the first check SUM data from the second storage unit 202, and, if values of the two data are different from each other, and drives the ROM interface 201 such that the second storage unit 202 retrieves the driving data and the first check SUM data from the first storage unit 102, again.

To do this, the data error detection/correction unit 203 includes a check SUM generating unit 203*a* and a check SUM comparing unit 203*b*.

The check SUM generating unit 203*a* generates a second check SUM data with reference to the driving data from the second storage unit 202.

The check SUM comparing unit 203*b* compares the second check SUM data from the check SUM generating unit 203*a* to the first check SUM data from the second storage unit 202, and, if values of the two data are different from each other, generates a driving signal and supplies the driving signal to the ROM interface 201. In this instance, the ROM interface 201 re-supplies the driving data and the first check SUM data from the first storage unit 102 to the second storage unit 202 in response to the driving signal from the check SUM comparing unit 203*b*.

The ROM interface 201, serving to set data communication between the first storage unit 102 and the second storage unit 202, transmits the driving data and the first check SUM data from the first storage unit 102 to the second storage unit 202 by using SPI or $I^2C$ protocol. In this instance, the ROM interface 201 is driven in response to a driving signal from an external CPU initially, and transmits the driving data and the first check SUM data from the first storage unit 102 to the second storage unit 202 before a picture is displayed on the display device. Thereafter, the ROM interface 201 is driven only when the driving signal is supplied thereto from the check SUM comparing unit 203*b*.

The timing controller 411 generates a data control signal and a gate control signal by using a dot clock, a data enable signal, horizontal and vertical synchronizing signals supplied thereto externally, and controls driving timings of the data driver 412 and the gate driver 413, respectively. The data control signal includes a source shift clock SSC, a source start pulse SSP, a polarity control signal POL, a source output enable signal SOE, and so on, and the gate control signal includes a gate start pulse GSP, a gate shift clock GSC, and a gate output enable signal GOE, and so on.

The gamma reference voltage generating unit 204 generates a plurality of gamma reference voltages according to the driving data from the second storage unit 202.

The gate driver 413 includes a shift register for generating the gate drive signal in response to the gate control signal from the timing controller 411 in succession. The gate driver 413 applies the gate drive signal in response to the gate control signal from the timing controller 411 in succession for turning on thin film transistors connected to the gate lines, respectively. In this instance, the gate driver 413 fixes a high level voltage and a low level voltage of the gate drive signal according to a gate high voltage and a gate low voltage provided thereto.

The data driver 412 generates a plurality of gamma voltages by using the gamma reference voltages from the gamma reference voltage generating unit 204, and converts a picture data from the frame memory 555 to the gamma voltage and supplies the gamma voltage to the data lines. That is, the data driver 412 receives analogous gamma voltages of a line portion relevant to every period of supply of the gate drive signal from the frame memory 555 and supplies the analogous gamma voltages to the data lines. In this instance, the data driver 412 can invert a polarity of the analogous gamma voltages being supplied to the data lines in response to the polarity control signal.

The external interface 521 receives picture data related to a motion picture from a system and supplies to the multiplexer MUX.

The system interface 522 receives picture data related to a still picture from a system and supplies to the multiplexer MUX.

The multiplexer MUX selects one kind from picture data related to a motion picture and picture data related to a still picture supplied thereto in response to a picture selection signal which informs whether a picture intending to process at the present time is a motion picture or a still picture and supplies selected data to the frame memory 555.

The picture selection signal is provided from the CPU.

In the meantime, the system interface 522 may receive picture data from the frame memory 555 and supplies the picture data to a defect processing unit under the instruction from the CPU for determining existence of defect in the picture data stored in the frame memory 555.

The display panel 100 has a plurality of pixel cells, including a plurality of red pixel cells for displaying red pictures, a plurality of green pixel cells for displaying green pictures, and a plurality of blue pixel cells for displaying blue pictures.

The picture data include red picture data for displaying the red pictures, green picture data for displaying green pictures, and blue picture data for displaying blue pictures.

The plurality of gamma voltages include a plurality of red gamma voltages for the red picture data, a plurality of green gamma voltages for the green picture data, and a plurality of blue gamma voltages for the blue picture data.

The gamma reference voltages include a plurality of red gamma reference voltages required for generation of the red gamma voltages, a plurality of green gamma reference voltages required for generation of the green gamma voltages, and a plurality of blue gamma reference voltages required for generation of the blue gamma voltages.

The driving data include a plurality of red driving data which are digital signals representing the red gamma reference voltages respectively, a plurality of green driving data which are digital signals representing the green gamma reference voltages respectively, and a plurality of blue driving data which are digital signals representing the blue gamma reference voltages respectively.

The first check SUM data includes a first red check SUM data generated with reference to the red driving data stored in the first storage unit 102, a first green check SUM data generated with reference to the green driving data stored in the first storage unit 102, and a first blue check SUM data generated with reference to the blue driving data stored in the first storage unit 102.

The first red check SUM data is obtained by the following method.

First, a SUM red driving data is generated, which is a sum of all of the red driving data each having n bits (n is a natural numeral). For an example, if there are 9 red driving data in total, and each of the red driving data has 8 bits, the 9 8 bit red driving data are added together to generate the SUM red driving data.

Second, if the SUM red driving data exceeds n bits, exceeded bits (overflow bits) are discarded. For an example, if the SUM red driving data has 9 bits, a bit positioned at a ninth digit (the most significant bit) is discarded, to make the SUM red driving data to be 8 bits the same as before.

Third, by adding unity to a least significant bit of the n bit SUM red driving data, and inverting logic of all bits of the n bit SUM red driving data having the unity added thereto, the first red check SUM data is generated. For an example, by adding unity to a least significant bit of the 8 bit SUM red driving data, and inverting logic of all bits of the 8 bit SUM red driving data, the first red check SUM data of 8 bits is generated.

The first green check SUM data is obtained by the following method.

First, a SUM green driving data is generated, which is a sum of all of the green driving data each having n bits (n is a natural numeral). For an example, if there are 9 green driving data in total, and each of the green driving data has 8 bits, the 9 8 bit green driving data are added together to generate the SUM green driving data.

Second, if the SUM green driving data exceeds n bits, exceeded bits (overflow bits) are discarded. For an example, if the SUM green driving data has 9 bits, a bit positioned at a ninth digit (the most significant bit) is discarded, to make the SUM green driving data to be 8 bits the same as before.

Third, by adding unity to a least significant bit of the n bit SUM green driving data, and inverting logic of all bits of the n bit SUM green driving data having the unity added thereto, the first green check SUM data is generated. For an example, by adding unity to a least significant bit of the 8 bit SUM green driving data, and inverting logic of all bits of the 8 bit SUM green driving data, the first green check SUM data of 8 bits is generated.

The first blue check SUM data is obtained by the following method.

First, a SUM blue driving data is generated, which is a sum of all of the blue driving data each having n bits (n is a natural numeral). For an example, if there are 9 blue driving data in total, and each of the blue driving data has 8 bits, the 9 8 bit blue driving data are added together to generate the SUM blue driving data.

Second, if the SUM blue driving data exceeds n bits, exceeded bits (overflow bits) are discarded. For an example, if the SUM blue driving data has 9 bits, a bit positioned at a ninth digit (the most significant bit) is discarded, to make the SUM blue driving data to be 8 bits the same as before.

Third, by adding unity to a least significant bit of the n bit SUM blue driving data, and inverting logic of all bits of the n bit SUM blue driving data having the unity added thereto, the first blue check SUM data is generated. For an example, by adding unity to a least significant bit of the 8 bit SUM blue driving data, and inverting logic of all bits of the 8 bit SUM blue driving data, the first blue check SUM data of 8 bits is generated.

The first red check SUM data, the first green check SUM data and the first blue check SUM data obtained thus are stored in the first storage unit 102 together with the driving data (the red driving data, the green driving data, and the blue driving data). The first red check SUM data, the first green check SUM data, the first blue check SUM data, and the driving data (the red driving data, the green driving data, and the blue driving data) are stored in the second storage unit 202 by the ROM interface 201.

The check SUM generating unit 203*a* generates a new second check SUM data with reference to the driving data (the red driving data, the green driving data, and the blue driving data) stored in the second storage unit 202.

The second check SUM data includes a second red check SUM data generated with reference to the red driving data stored in the second storage unit 202, a second green check SUM data generated with reference to the green driving data stored in the second storage unit 202, and a second blue check SUM data generated with reference to the blue driving data stored in the second storage unit 202.

The check SUM generating unit 203*a* generates the second red check SUM data, the second green check SUM data, and the second blue check SUM data. That is, the check SUM generating unit 203*a* generates the second red check SUM data, the second green check SUM data, and the second blue check SUM data with reference to the driving data (the red driving data, the green driving data, and the blue driving data) stored from the second storage unit 202.

The second red check SUM data is obtained by a method identical to the method for obtaining the first red check SUM data described before, except that the second red check SUM data is obtained from the red driving data stored in the second storage unit 202.

The second green check SUM data is obtained by a method identical to the method for obtaining the first green check SUM data described before, except that the second green check SUM data is obtained from the green driving data stored in the second storage unit 202.

The second blue check SUM data is obtained by a method identical to the method for obtaining the first blue check SUM data described before, except that the second blue check SUM data is obtained from the blue driving data stored in the second storage unit 202.

FIG. 3 illustrates driving data of a color relevant to either the first check SUM data or the second check SUM data and a check SUM data derived from the driving data of a color.

Referring to FIG. 3, 8 bit driving data of respective colors (the red driving data, the green driving data, and the blue driving data) are in storage in respective addresses. By carrying out the second to third steps described above by using the driving data at respective addresses, check SUM data relevant to the driving data of relevant color can be obtained.

The second red check SUM data, the second green check SUM data, and the second blue check SUM data obtained thus are supplied to the check SUM comparing unit 203*b*. The check SUM comparing unit 203*b* also has the first red check SUM data, the first green check SUM data, and the first blue check SUM data supplied thereto from the second storage unit 202.

The check SUM comparing unit 203*b* compares the first red check SUM data to the second red check SUM data, the first green check SUM data to the second green check SUM data, and the first blue check SUM data to the second blue check SUM data. If even any one kind of the check SUM data of respective colors are different as a result of the comparison, the check SUM comparing unit 203*b* generates a driving signal and supplies to the ROM interface 201. Then, the ROM interface 201 supplies the driving data (the red driving data, the green driving data, and the blue driving data) and the first check SUM data (the first red check SUM data, the first green check SUM data, and the first blue check SUM data) from the first storage unit 102 to the second storage unit 202, again. Then, the driving data and the first check SUM data stored in the second storage unit 202 already are renewed with the driving data and the first check SUM data supplied thereto from the first storage unit 102 newly. Opposite to this, if all of the check SUM data of respective colors are the same respectively as the result of the comparison, as described before, the data error detection/correction unit 203 generates new second red check SUM data, new second green check SUM data, and new second blue check SUM data from the red driving data, the green driving data, and the blue driving data from the second storage unit 202, and compares the new second red check SUM data, the new second green check SUM data, and the new second blue check SUM data to the first red check SUM data, the first green check SUM data, and the first blue check SUM data stored in the second storage unit 202, again. That is, the data error detection/correction unit 203 verifies existence of an error at the driving data in the second storage unit 202, periodically.

By repeating operation described above, the data error detection/correction unit 203 compares whether the driving data in the first storage unit 102 is the same with the driving data in the second storage unit 202 or not. That is, the data error detection/correction unit 203 repeats above operation until the driving data in the first storage unit 102 becomes the same with the driving data in the second storage unit 202.

By doing this, the driving data in the first storage unit 102 can always be maintained the same with the driving data in the second storage unit 202.

A method for driving a display device in accordance with a preferred embodiment of the present invention.

Figure 4:
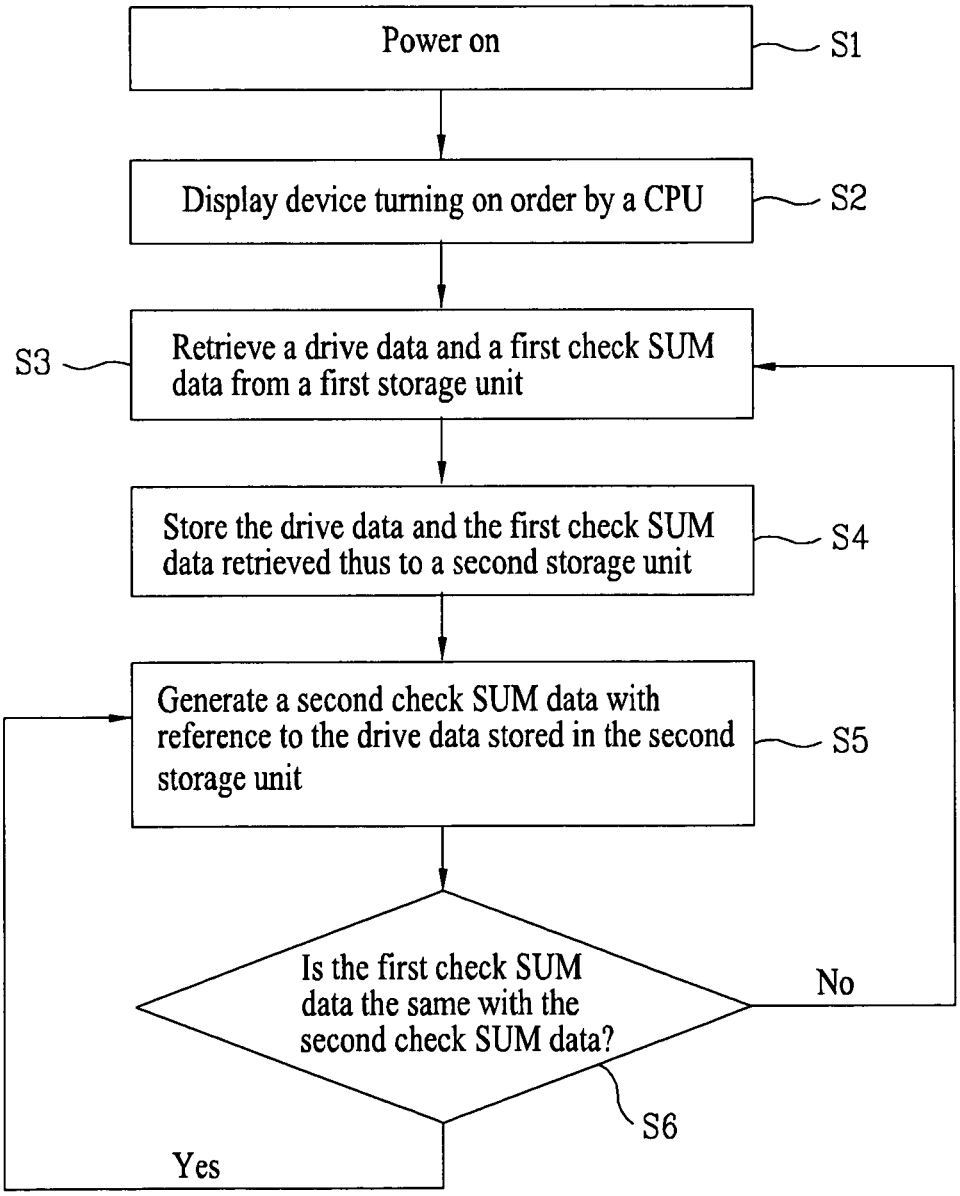
FIG. 4 illustrates a flow chart showing the steps of a method for driving a display device in accordance with a preferred embodiment of the present invention.

FIG. 4 illustrates a flow chart showing the steps of a method for driving a display device in accordance with a preferred embodiment of the present invention.

Upon power is applied to the display device, a display turning on order is supplied from a CPU to the display device for driving the display device (S1, and S2).

Then, the CPU retrieves driving data required for driving the display panel 100, and a first check SUM data for the driving data (S3).

Then, the CPU stores the driving data and the first check SUM data retrieved thus in the second storage unit 202 (S4).

Next, the CPU generates a second check SUM data with reference to the driving data stored in the second storage unit 202 (S5).

Thereafter, the second check SUM data is compared to the first check SUM data from the second storage unit 202. If values of the second check SUM data and the first check SUM data are different from each other, the driving data and the first check SUM data from the first storage unit 102 is supplied to the second storage unit 202 again. Opposite to this, if the second check SUM data and the first check SUM data from the second storage unit 202 are compared to find values of the second check SUM data and the first check SUM data are the same, the second check SUM data and the first check SUM data from the second storage unit 202 are compared periodically, for verifying existence of error in the driving data in the second storage unit 202.

Next, a plurality of gamma reference voltages are generated according to the driving data from the second storage unit 202.

Thereafter, a plurality of gamma voltages are generated by using the gamma reference voltages.

Then, a picture data from the frame memory 555 is converted into the gamma voltage and supplies the gamma voltage to the data lines in the display panel 100.

Because existence of error at the driving data stored in the second storage unit 202 is verified by using the check SUM data, and the driving data is resupplied from the first storage unit 102 to the second storage unit 202 if there is an error at the driving data as a result of the verification, the driving data at the second storage unit 202 can be maintained the same with the driving data at the first storage unit 102 always even if the error takes place at the driving data supplied to the second storage unit 202 due to noise at the time the driving data is transmitted from the first storage unit 102 to the second storage unit 202.

As has been described, the display device and the method for driving the same of the present invention have the following advantages.

Because existence of an error in the drive data stored in the second storage unit is verified by using the check SUM data, and, if there is the error as a result of verification, the drive data is re-transmitted from the first storage unit to the second storage unit, the drive data in the second storage unit can always be maintained the same with the drive data in the first storage unit by detecting and correcting the error even if the error takes place at the drive data supplied to the second drive unit due to noise at the time of transmission of the drive data from the first storage unit to the second storage unit.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a first storage unit having a driving data required for driving a display panel and a first check SUM data on the driving data stored therein;

a second storage unit for retrieving the driving data and the first check SUM data from the first storage unit and storing the driving data and the check SUM data therein in response to the instruction of a ROM interface;

a data error detection/correction unit for generating a second check SUM data with reference to the driving data stored in the second storage unit, comparing the second check SUM data with the first check SUM data from the second storage unit, and driving the ROM interface such that the second storage unit retrieves the driving data and the first check SUM data from the first storage unit, again if a value of the first check SUM data and a value of the second check SUM data are different from each other;

a gamma reference voltage generating unit for generating a plurality of gamma reference voltages according to the driving data from the second storage unit;

a data driver for generating a plurality of gamma voltages by using the gamma reference voltages from the gamma reference voltage generating unit, and converting a picture data from a frame memory to the gamma voltage and supplies the gamma voltage to data lines in the display panel;

wherein the data error detection/correction unit includes:

a check SUM generating unit for generating the second check SUM data with reference to the driving data from the second storage unit; and a check SUM comparing unit for comparing the second check SUM data from the check SUM generating unit with the first check SUM data from the second storage unit, and generating a driving signal and supplies the driving signal to the ROM interface if a value of the first check SUM data and a value of the second check SUM data are different from each other;

wherein the ROM interface re-supplies the driving data and the first check SUM data from the first storage unit to the second storage unit in response to the driving signal from the check SUM comparing unit, wherein the picture data includes red picture data for displaying the red pictures, green picture data for displaying green pictures, and blue picture data for displaying blue pictures, the plurality of gamma voltages include a plurality of red gamma voltages for the red picture data, a plurality of green gamma voltages for the green picture data, and a plurality of blue gamma voltages for the blue picture data, the gamma reference voltages include a plurality of red gamma reference voltages required for generation of the red gamma voltages, a plurality of green gamma reference voltages required for generation of the green gamma voltages, and a plurality of blue gamma reference voltages required for generation of the blue gamma voltages, and the driving data include a plurality of red driving data which are digital signals representing the red gamma reference voltages respectively, a plurality of green driving data which are digital signals representing the green gamma reference voltages respectively, and a plurality of blue driving data which are digital signals representing the blue gamma reference voltages respectively;

wherein the first check SUM data includes a first red check SUM data generated with reference to the red driving data stored in the first storage unit, a first green check SUM data generated with reference to the green driving data stored in the first storage unit, and a first blue check SUM data generated with reference to the blue driving data stored in the first storage unit, wherein the first red check SUM data is generated by a method including the steps of generating a SUM red driving data by summing of all of the red driving data each having n bits, discarding overflow bits exceeding the n bits from the SUM red driving data to generate the SUM red driving data of n bits, and adding an 1 to a least significant bit of the n bit SUM red driving data, and inverting logic of all bits of the n bit SUM red driving data having the 1 added thereto, the first green check SUM data is generated by a method including the steps of generating a SUM green driving data by summing of all of the green driving data each having n bits, discarding overflow bits exceeding the n bits from the SUM green driving data to generate the SUM green driving data of n bits, and adding an 1 to a least significant bit of the n bit SUM green driving data, and inverting logic of all bits of the n bit SUM green driving data having the 1 added thereto, and the first blue check SUM data is generated by a method including the steps of generating a SUM blue driving data by summing of all of the blue driving data each having n bits, discarding overflow bits exceeding the n bits from the SUM blue driving data to generate the SUM blue driving data of n bits, and adding an 1 to a least significant bit of the n bit SUM blue driving data, and inverting logic of all bits of the n bit SUM blue driving data having the 1 added thereto.

2. The display device as claimed in claim 1, wherein the second check SUM data includes a second red check SUM data generated with reference to the red driving data stored in the second storage unit, a second green check SUM data generated with reference to the green driving data stored in the second storage unit, and a second blue check SUM data generated with reference to the blue driving data stored in the second storage unit, wherein the second red check SUM data is generated by a method including the steps of generating a SUM red driving data by summing of all of the red driving data each having n bits, discarding overflow bits exceeding the n bits from the SUM red driving data to generate the SUM red driving data of n bits, and adding an 1 to a least significant bit of the n bit SUM red driving data, and inverting logic of all bits of the n bit SUM red driving data having the 1 added thereto, the second green check SUM data is generated by a method including the steps of generating a SUM green driving data by summing of all of the green driving data each having n bits, discarding overflow bits exceeding the n bits from the SUM green driving data to generate the SUM green driving data of n bits, and adding an 1 to a least significant bit of the n bit SUM green driving data, and inverting logic of all bits of the n bit SUM green driving data having the 1 added thereto, and the second blue check SUM data is generated by a method including the steps of generating a SUM blue driving data by summing of all of the blue driving data each having n bits, discarding overflow bits exceeding the n bits from the SUM blue driving data to generate the SUM blue driving data of n bits, and adding an 1 to a least significant bit of the n bit SUM blue driving data, and inverting logic of all bits of the n bit SUM blue driving data having the 1 added thereto.

3. The display device as claimed in claim 2, wherein the check SUM comparing unit compares the first red check SUM data with the second red check SUM data, the first green check SUM data with the second green check SUM data, and the first blue check SUM data with the second blue check SUM data.

4. The display device as claimed in claim 1, wherein the first storage unit is a ROM (Read Only Memory), and the second storage unit is a RAM (Random Access Memory).

5. A method for driving a display device comprising the steps of:

storing a driving data required for driving a display panel and a first check SUM data on the driving data in a first storage unit;

retrieving the driving data and the first check SUM data from the first storage unit and storing the driving data and the check SUM data in a second storage unit in response to the instruction of a ROM interface;

generating a second check SUM data with reference to the driving data stored in the second storage unit; and comparing the second check SUM data with the first check SUM data from the second storage unit, and, supplying the driving data and the first check SUM data from the first storage unit to the second storage unit again if a value of the first check SUM data and a value of the second check SUM data are different from each other, wherein the first check SUM data is generated by a method including the steps of generating a SUM driving data by summing of all of the driving data each having n bits, discarding overflow bits exceeding the n bits from the SUM driving data to generate the SUM driving data of n bits, and adding an 1 to a least significant bit of the n bit SUM driving data, and inverting logic of all bits of the n bit SUM driving data having the 1 added thereto.

6. The method as claimed in claim 5, further comprising the steps of:

generating a plurality of gamma reference voltages with reference to the driving data from the second storage unit;

generating a plurality of gamma voltages by using the gamma reference voltages; and converting a picture data from a frame memory into a gamma voltage and supplying the gamma voltage to data lines in the display panel.

* * * * *